US005780387A

United States Patent [19]

Harada

[11] Patent Number: 5,780,387

[45] Date of Patent: Jul. 14, 1998

[54] REVERSIBLE THERMOSENSITIVE RECORDING MEDIUM

[75] Inventor: Shigeyuki Harada, Mishima, Japan

[73] Assignee: Ricoh Company, Ltd., Tokyo, Japan

[21] Appl. No.: 700,784

[22] Filed: Aug. 22, 1996

[30] Foreign Application Priority Data

Aug. 22, 1995 [JP] Japan ..... 7-234642
Aug. 12, 1996 [JP] Japan ..... 8-227380

[51] Int. Cl.[6] ..... B41M 5/40

[52] U.S. Cl. ..... 503/226; 503/201; 503/207; 503/217; 427/152

[58] Field of Search ..... 503/201, 207, 503/217, 226; 427/152

[56] References Cited

PUBLICATIONS

Japanese Laid–Open Patent Application 2–258287 (English Abstract).
English Translation of JIS K 5401.
Japanese Laid–Open Patent Application 2–188293 (English Abstract).
Japanese Laid–Open Patent Application 62–55650 (English Abstract).
Japanese Laid–Open Patent Application 1–133781 (English Abstract).
Japanese Laid–Open Patent Application 63–191673 (English Abstract).
Japanese Laid–Open Patent Application 2–135418 (English Abstract).
Japanese Laid–Open Patent Application 63–315288 (English Abstract).

*Primary Examiner*—Bruce H. Hess
*Attorney, Agent, or Firm*—Oblon, Spivak, McClelland, Maier & Neustadt, P.C.

[57] ABSTRACT

A reversible thermosensitive recording medium includes a support material; a thermosensitive recording layer whose transparency is reversibly changeable depending upon the temperature thereof, which is provided on the support material and includes a low-molecular-weight organic compound and a resin matrix in which the organic low-molecular-weight compound is dispersed; and an overcoat layer provided on the thermosensitive recording layer, the overcoat layer having a pencil hardness of 1H or more and including at the surface thereof at least three protrusions with a height of 0.05 μm or more per area of 125 μm×125 μm of the surface of the overcoat layer.

18 Claims, 1 Drawing Sheet

REVERSIBLE THERMOSENSITIVE RECORDING MEDIUM

BACKGROUND OF THE INVENTION

1. Field of the Invention

The present invention relates to a reversible thermosensitive recording medium which is capable of reversibly recording information and erasing recorded information by utilizing temperature-dependent reversible changes in the transparency of the recording medium.

2. Discussion of Background

Conventionally various recording media or materials have been known, which are capable of recording information and deleting recorded information reversibly.

To be more specific, Japanese Laid-Open Patent Application 63-191673 discloses a recording material which utilizes a polymeric nematic liquid crystal with an isotropic phase transition point thereof being higher than the glass transition point thereof, and is capable of rewriting recorded information by the application of heat or light thereto.

Japanese Laid-Open Patent Application 2-135418 discloses a transparent color display recording medium which utilizes a liquid crystal film comprising a thermotropic polymer cholesteric liquid crystal, and is capable of thermally rewriting recorded information.

Japanese Laid-Open Patent Application 63-315288 discloses a recording material capable of thermally coloring information to be recorded therein or decolorizing recorded information, in which an electron donative coloring organic material having a lactone ring in the molecule thereof and an electron acceptor compound are made miscible in a liquid crystal medium.

Japanese Laid-open Patent Application 2-188293 discloses a thermosensitive recording medium provided with a recording layer which comprises a leuco compound and a color developing or decolorizing agent which is capable of reacting with the leuco compound and inducing a color in the leuco dye or decolorizing a developed color.

Japanese Laid-Open Patent Applications 54-119377 and 55-154198 disclose recording media, each of which is provided with a thermosensitive recording layer comprising a resin matrix such as polyester resin, and an organic low-molecular-weight material, such as a higher alcohol or a higher fatty acid, which is dispersed in the resin matrix, and is capable of recording information and erasing recorded information reversibly by utilizing the properties of the recording medium that the transparency thereof can be reversibly changed depending upon the temperature of the recording medium.

In the above-mentioned reversible thermosensitive recording media or materials, however, when images are formed for recording information thereon by use of heat application means such as a thermal head, the friction between such heat application means and the recording layer of the recording medium or material is so large that there occur problems that such a thermal head sticks to the recording layer, or forms periodic undulations in the surface of the recording layer, corresponding to the dot density of the thermal head, because the surface of the recording layer is easily deformed by the heat or pressure applied thereto by such heat application means, and such deformation is built up during repeated image formation, and eventually it becomes difficult to obtain clear images.

In order to solve the above problems, Japanese Laid-Open Patent Application 62-55650 discloses a method of minimizing the friction coefficient of the surface of the thermosensitive recording layer of such a recording medium by providing thereon an overcoat layer made of silicone resin or silicone rubber. This method, however, has the shortcomings that the adhesion between the overcoat layer and the thermosensitive recording layer is insufficient for use in practice, so that the overcoat layer is peeled away from the thermosensitive layer while in repeated use and the quality of obtained images eventually deteriorates.

In order to improve the adhesion between the overcoat layer and the thermosensitive recording layer, there has been proposed the provision of an intermediate layer between the overcoat layer and the thermosensitive recording layer, namely a reversible thermosensitive recording medium as disclosed in Japanese Laid-Open Patent Application 1-133781, which comprises a reversible thermosensitive recording layer, an intermediate layer composed of a resin as the main component which is provided on the reversible thermosensitive recording layer, and an overcoat layer composed of a heat resistant resin as the main component, which is provided on the intermediate layer.

By the provision of the intermediate layer, the adhesion between the overcoat layer and the thermosensitive recording layer is improved to some extent, and the deformation of the surface of the recording layer is reduced by use of the overcoat layer composed of a heat resistant resin an the main component. However, still unsolved problems are that the surface of the recording layer is scratched during the repeated printing or image formation and erasure of recorded images, and part of the overcoat layer is peeled off the recording layer and adheres to the thermal head, and such peeled dust is built up on the thermal head and significantly decreases the heat transfer from the thermal head to the recording layer, making it difficult to obtain clear images.

Japanese Laid-Open Patent Application 2-258287 discloses a reversible thermosensitive recording material provided with a top layer which has a surface roughness of 0.5 to 3 μm in the form of fine undulations. In this reversible thermosensitive recording material, the formation of periodic undulations in the surface of the recording material, corresponding to the dot density of a thermal head employed, can be reduced to some extent, but the problems that scratches are formed in the surface of the recording material, a thermal head sticks to the recording material, and the thermal head smears while in use are still unsolved.

SUMMARY OF THE INVENTION

It in therefore an object of the present invention to provide a reversible thermosensitive recording medium free from the above-mentioned conventional problems, capable of preventing the formation of periodic undulations in the surface of the recording medium, corresponding to the dot density of a thermal head employed, and also free from the problems of the deterioration of image quality and the reduction of thermal sensitivity, which may be caused by the formation of scratches in the surface of the recording material, the sticking of a thermal head to the recording material, and the smearing of a thermal head while in use.

This object of the present invention can be achieved by a reversible thermosensitive recording medium which comprises a support material; a thermosensitive recording layer whose transparency is reversibly changeable depending upon the temperature thereof, which is provided on the support material and comprises an organic low-molecular-weight compound and a resin matrix in which the organic low-molecular-weight compound is dispersed; and an overcoat layer provided on the thermosensitive recording layer, the overcoat layer having a pencil hardness of 1H or more, preferably in the range of 1H to 8H, measured in accordance with the Japanese Industrial Standards, JIS X5401, and comprising at the surface thereof at least three, preferably 3 to 900, protrusions with a height of 0.05 μm or more, preferably in the range of 0.05 μm to 1.50 μm, per area of 125 μm×125 μm of the surface of the overcoat layer.

In the above reversible thermosensitive recording medium, the overcoat layer may comprise at least two overlaid layers, with a top layer of the overlaid layes having a pencil hardness of 1H or more and comprising the above-mentioned protrusions at the surface thereof.

In the above reversible thermosensitive recording medium, an adhesive layer may be provided between the thermosensitive recording layer and the overcoat layer.

In the above reversible thermosensitive recording medium, the surface area of the overcoat layer except the protrusions thereon is preferably flat.

In the reversible thermosensitive recording medium, each of the protrusions may comprise particles, preferably with a particle size in the range of 0.1 to 3.0 μm.

In the reversible thermosensitive recording medium, at least part of the overcoat layer comprises a thermoset resin composition, an ultraviolet-curling resin composition, or an electron radiation curing resin composition.

When the reversible thermosensitive recording medium comprises an overcoat layer comprising at least two overlaid layers, the top layer may have a pencil hardness in the range of 1H to 5H.

Furthermore, in the above reversible thermosensitive recording medium, at least one of the thermosensitive recording layer or the overcoat layer may further comprise a coloring agent.

When the overcoat layer comprises at least two overlaid layers, at least one of the overlaid layers of the overcoat layer may further comprise a coloring agent.

Furthermore, in the reversible thermosensitive recording medium of the present invention, a printed image which may be disposed between the thermosensitive recording layer and the overcoat layer.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein.

DESCRIPTION OF THE PREFERRED EMBODIMENTS

Figure 1:
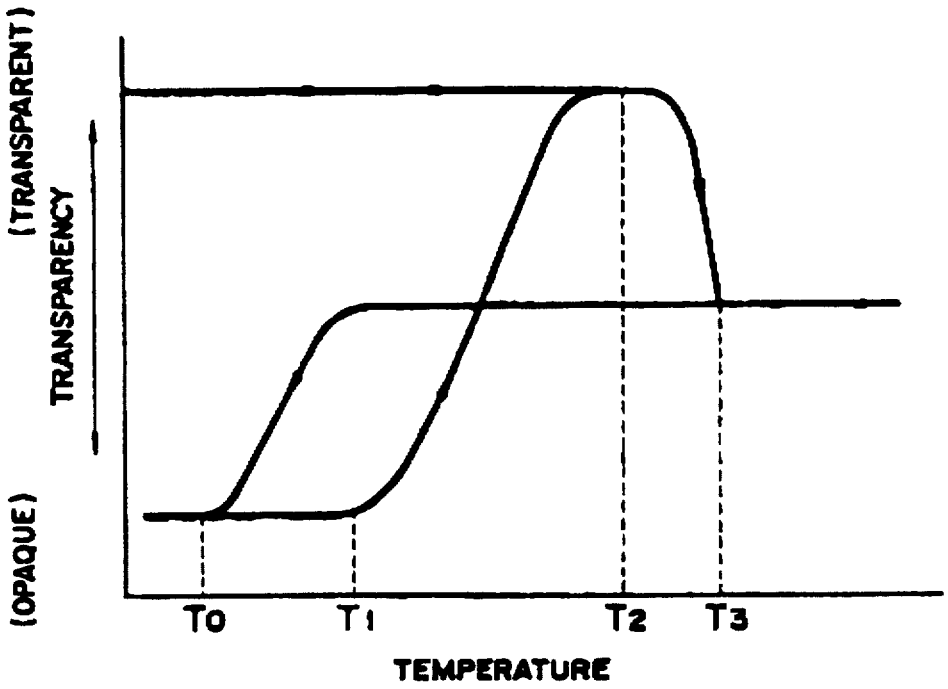
FIG. 1 is a diagram in explanation of the principle of formation and erasure of images in a reversible thermosensitive recording medium of the present invention.

The reversible thermosensitive recording medium of the present invention is capable of recording image and erasing recorded images by utilizing the properties that the state thereof can be switched from a transparent state to a milky white opaque state, and vice versa depending upon the temperature thereof.

More specifically, FIG. 1 is a diagram of the coloring and decolorizing characteristics of the reversible thermosensitive recording medium of the present invention.

In FIG. 1, it is supposed that the thermosensitive recording layer of the reversible thermosensitive recording medium, comprising a matrix resin and a low-molecular-weight organic material dispersed in the matrix resin, is initially in a maximum milky white opaque state at room temperature $T_0$ or below. When the thermosensitive recording layer is heated to temperature $T_2$, the thermosensitive recording layer becomes transparent and reaches a maximum transparent state at temperature $T_2$. Even if the thermosensitive recording layer which is already in the maximum transparent state is cooled to room temperature $T_0$ or below, the maximum transparent state is maintained.

When the thermosensitive recording layer in the maximum transparent state is further heated to temperature $T_3$ or more, the thermosensitive recording layer assumes a medium state which is between the maximum transparent state and the maximum milky white opaque state.

When the thermosensitive recording layer in the medium state at temperature $T_3$ or more is cooled to room temperature $T_0$ or below, thermosensitive recording layer returns to the initial maximum milky white opaque state, without passing through any transparent state.

If the thermosensitive recording layer in the milky white opaque state is heated to any temperature between temperature $T_1$ and temperature $T_2$, and then cooled to room temperature $T_0$ or below, the thermosensitive recording layer assumes an intermediate state between the transparent state and the milky white opaque state.

When the thermosensitive recording layer in the transparent state at room temperature $T_0$ or below is again heated to temperature $T_3$ or above, and then cooled to room temperature $T_0$, the thermosensitive recording layer returns to the milky white opaque state.

Thus, the thermosensitive recording layer can assume a milky white maximum opaque state, a maximum transparent state and an intermediate state between the aforementioned two states at room temperature.

Thus, by applying heat to a thermosensitive recording medium provided with the above-mentioned thermosensitive recording layer so as to apply heat selectively to the thermosensitive recording layer, a milky white opaque image can be obtained on a transparent background, or a transparent image can be obtained on a milky white opaque background. Further, such image formation can be repeated many times.

When a colored sheet is placed behind the thermosensitive recording layer of the reversible thermosensitive recording medium of the present invention a colored image can be obtained on the milky white opaque background, or a white opaque image can be obtained on the colored background.

In the case where the reversible thermosensitive recording medium of the present invention is projected by using an OHP (Over Head Projector), a milky white opaque portion in the recording medium appears a dark portion, and a transparent portion in the recording medium through which the light passes becomes a bright portion on the screen.

The reversible thermosensitive recording medium of the present invention comprises a support material; a thermosensitive recording layer whose transparency is reversibly changeable depending upon the temperature thereof, which is provided on the support material and comprises a low-molecular-weight organic compound and a resin matrix in which the low-molecular-weight organic compound is dispersed; and an overcoat layer provided on the thermosensitive recording layer, the overcoat layer having a pencil hardness of 1H or more, and comprising at the surface thereof at least three protrusions with a height of 0.05 μm or more per area of 125 μm×125 μm of the surface of the overcoat layer.

In the present invention, the height of the protrusions can be measured by a contact type or non-contact type three dimensional surface roughness meter, for instance, "Surfcorder SE-30K" made by Kosaka Laboratory Co., Ltd.

The dot density of a currently commercially available thermal head is 8 dots/mm, which can be converted into an area of 125 μm×125 μm in terms of the area per dot.

According to the present invention, by providing on the thermosensitive recording layer the overcoat layer having a pencil hardness of 1H or more and comprising at the surface thereof at least three protrusions with a height of 0.05 μm or more per area of 125 μm×125 μm of the surface of the overcoat layer, there can be obtained a reversible thermosensitive recording medium capable of preventing the formation of periodic undulations in the surface of the recording medium, corresponding to the dot density of a thermal head employed, and free from the problems of the deterioration of image quality and the reduction of thermal sensitivity, which may be caused by the formation of scratches in the surface of the recording medium, the sticking of a thermal head to the recording medium, peeling of the recording layer, and the smearing of a thermal head during repeated image formation and erasure of recorded images.

The protrusions formed at the surface of the overcoat layer serve to prevent the formation of the scratches in the surface of the recording medium, and the sticking of a thermal head to the recording medium. In other words, the provision of the protrusions at the surface of the overcoat layer reduces the contact area of the thermal head with the overcoat layer in comparison with the case where the overcoat layer is free from such protrusions and smooth, and accordingly reduces the friction between the surface of the overcoat layer and the thermal head, so that there can be prevented the formation of the scratches in the surface of the recording medium, and the sticking of the thermal head to the recording medium.

The above-mentioned effects depend upon the number of the protrusions per unit area of the overcoat layer, and the height of the protrusions.

It is preferable that the number of the protrusions per area of 125 μm×125 μm of the surface of the overcoat layer be in the range of 3 to 900.

When the number of the protrusions per area of 125 μm×125 μm of the surface of the overcoat layer is less than 3, the contact area of the thermal head with the overcoat layer becomes substantially the same as in the case where the overcoat layer is free from such protrusions and smooth, so that there cannot be obtained the affect of preventing the formation of periodic undulations in the surface of the recording medium, corresponding to the dot density of a thermal head employed, and there cannot be obtained the effects of preventing the formation of scratches in the surface of the recording medium and the sticking of a thermal head to the recording medium, peeling of the recording layer, and the smearing of a thermal head during repeated image formation and erasure of recorded images, either.

Furthermore, when the number of the protrusions per area of 125 μm×125 μm of the surface of the overcoat layer is more than 900, the transparency of the portions that must be transparent in the reversible thermosensitive recording medium significantly decreases and therefore unclear images are formed.

It is preferable that the protrusions have a height in the range of 0.05 μm to 1.50 μm, since when the height of the protrusions is less than 0.05 μm, the contact area of the thermal head with the overcoat layer becomes substantially the same as in the case where the overcoat layer is free from such protrusions and smooth, so that there cannot be obtained the effects of preventing the formation of scratches in the surface of the recording medium and the sticking of a thermal head to the recording medium during repeated image formation and erasure of recorded images; while when the height of the protrusions is more than 1.5 μm, the contact area of the thermal head with the overcoat layer tends to become excessively small, so that the heat conduction from the thermal head to the thermosensitive recording layer is lowered and therefore image formation and erasure are difficult to perform by the normal application of thermal energy or at a conventional temperature.

As to the combination of the height of the protrudings and the number thereof per unit area of the overcoat layer in the present invention, it is preferable that the higher the protrusions, the smaller the number; or the lower the protrusions, the larger the number.

It is also preferable that the surface area of the overcoat layer except the protrusions thereon be flat for improvement of the thermosensitivity of the thermosensitive recording layer. In other words, when the areas around the protrusions are not flat or concave, the gap between the thermal head and the surface of the overcoat layer is larger than the gap formed between the thermal head and the flat overcoat layer, so that the thermosensitivity of the recording medium is lowered.

Furthermore, by setting the hardness of the overcoat layer at 1H or more in terms of the pencil hardness, there can be effectively prevented the formation of scratches in the recording layer, the peeling of the recording layer, and the smearing of a thermal head with the dust formed by the formation of scratches in the recording layer, and the peeling thereof.

A reversible thermosensitive recording medium provided with an overcoat layer having a pencil hardness of 1H or more can be used for image formation and erasure repeatedly 500 times or more, without being deformed or damaged by the heat from a thermal head, the friction with a thermal head, or the pressure applied by a thermal head.

When the pencil hardness of the overcoat layer is less than 1H, periodic undulations corresponding to the dot density of a thermal head employed are formed in the surface of the recording medium, or part of the overcoat layer is peeled off, and the peeled part of the overcoat layer is built up on the thermal head, so that the heat conductivity of the thermal head is significantly lowered and image formation cannot be performed properly.

On the other hand, when the pencil hardness of the overcoat layer is 9H or more, the overcoat layer cracks when the image formation and erasure operation is repeated 50 to 300 times, and the images formed in he recording layer becomes unclear. This tendency decreases as the hardness decreases. However, when the hardness is lose than 1H, the periodic undulations and scratches are apt to be formed and the peeling of the overcoat layer is apt to occur.

As the hardness is increased, the overcoat layer is apt to crack. Therefore, in the present invention, it is preferable that the overcoat layer have a pencil hardness in the range of 2H to 8H.

It is also preferable that the overcoat layer have a thickness of 0.1 to 10.0 μm, more preferably in the range of 1.0 to 6.0 μm, including the height of the protrusions formed at the surface of the overcoat layer.

In the reversible thermosensitive recording medium of the present invention, the overcoat layer may comprise at least two overlaid layers. In this case, it is preferable that a top layer of the overlaid layers have a pencil hardness of 1H or more, and comprise at the surface thereof at least three protrusions with a height of 0.05 μm or more per area of 125 μm×125 μm of the surface of the top layer.

By the provision of the overcoat layer which comprises at least two overlaid layers, there can be obtained a reversible thermosensitive recording medium free from the problems of the formation of periodic undulations in the surface of the recording medium, corresponding to the dot density of a thermal head employed, and also free from the problems of the formation of scratches in the surface of the recording medium and the sticking of a thermal head to the recording medium, peeling of the recording layer, and the smearing of a thermal head with the dust formed by the sticking of a thermal head to the recording medium and the peeling of the recording layer during repeated image formation and erasure of recorded images.

A first overlaid layer of the overcoat layer, which is disposed under the top layer, in used as a precursor layer to the top layer for setting the height and number of the protrusions formed at the surface of the second layer. In this case, the top layer may be referred to as a second layer.

More specifically, the protrusions formed on the first layer are reflected to the formation of the protrusions at the surface of the second layer of the overcoat layer with respect to the number and height of the protrusions.

It is necessary that the number of the protrusions to be formed at the surface of the first layer be larger than the number of the protrusions to be formed at the surface of the second layer of the overcoat layer. The ratio of the number of the protrusions to be formed at the surface of the first layer to the number of the protrusions to be formed on the surface of the second layer of the overcoat layer depends upon the relative thickness of the second layer with respect to the thickness of the first layer. To be more specific, when the second layer of the overcoat layer is made thicker than the first layer, a relatively large number of protrusions are formed on the first layer; while when the second layer of the overcoat layer is made thinner than the first layer, a relatively small number of protrusions are formed on the first layer.

Furthermore, it is necessary that the protrusions formed on the first layer of the overcoat layer be higher than the protrusions formed on the second layer which serves as the top layer of the overcoat layer. The ratio of the height of the protrusion formed on the first layer to that of the protrusions formed on the second layer depends upon the thickness of the second layer. When the second layer of the overcoat layer is made thicker than the first layer, relatively higher protrusions are formed on the first layer; while when the second layer of the overcoat layer is made thinner than the first layer, relatively lower protrusions are formed on the first layer.

When the overcoat layer comprises at least two overlaid layers, the top layer may have a pencil hardness in the range of 1H to 5H.

It is preferable that the overcoat layer comprising at least two overlaid layers have a thickness in the range of 0.1 to 10 μm, more preferably in the range of 1.0 to 6.0 μm.

Furthermore, in the reversible thermosensitive recording medium of the present invention, an adhesive layer may be provided between the thermosensitive recording layer and the overcoat layer.

In the present invention, the above-mentioned protrusions may comprise particles.

An overcoat layer with 3 to 900 protrusions with a height of 0.05 μm or more per area of 125 μm×125 μm of the surface of the overcoat layer can be prepared by dispersing particles in a coating liquid for the formation of the overcoat layer in a homogenizer or ball mill to prepare a dispersion, and coating the dispersion, for instance, on the thermosensitive recording layer and drying the coated dispersion; or by using a resin composition for the formation of the overcoat layer in combination with a good solvent for the resin in the resin composition and a poor solvent for the resin in the resin composition and/or a solvent with a relatively low boiling point and a solvent with a relatively high boiling point to prepare an overcoat layer formation liquid, and coating the overcoat layer formation liquid, for instance, on the thermosensitive recording layer and drying the coated overcoat layer formation liquid.

In order to obtain the protrusions easily and accurately as desired, it is preferable to employ particles with a particle size in the range of 0.1 to 3.0 μm.

In the case where the overcoat layer comprising two or more overlaid layers is prepared, it is preferable that the above-mentioned particle be employed in the overlaid layers other than the top layer in order to retain the particles within the overcoat layer for preventing a thermal head from being smeared with particles released from the overcoat layer.

Specific examples of particles with a particle size in the range of 0.1 to 3.0 μm for use in the present invention are inorganic particles of calcium carbonate, titanium oxide, zinc oxide, barium sulfate, aluminum silicate, magnesium hydroxide, magnesium carbonate, aluminum hydroxide, alumina or silica; and organic particles of urea-formaldehyde resin, or styrene resin.

In order to provide 3 to 900 protrusions with a height of 0.05 to 1.5 μm per area of 125 μm×125 μm of the surface of the overcoat layer, it is preferable to employ particles in an amount of 0.1 to 10 wt.% of the entire weight of the overcoat layer.

An overcoat layer with a pencil hardness of 2H or more, or in the range of 2H to 8H can be prepared by using as the main component for the overcoat layer a thermoplastic resin composition, a thermoset resin composition, an ultraviolet curing resin composition, or an electron radiation curing resin composition. These resin compositions may be used alone or in combination.

Specific examples of a thermoplastic resin for the thermoplastic resin composition are aromatic polyether ketone, aromatic polyether sulfone, polybenzoxazole, polybenzimidazole, polbenzothiazole, polyparabanic acid, polyparabanic acid copolymer, polyiminohydantoin copolymer, aromatic polyamide, aromatic polyamide copolymer, polyimide, polyimide copolymer, polyamideimide copolymer, polyarylate, polyarylate copolymer, or silicone-modified materials of the aforementioned compounds.

The thermoset resin composition is composed of a polymer and/or polymerizable compound having a functional group which is capable of forming a covalent bond in reaction with a crosslinking agent, a crosslinking agent, any crosslinking accelerating agent and a catalyst.

Examples of a polymer and/or polymerizable compound having a functional group which is capable of forming a covalent bond in reaction with a crosslinking agent are polyvinyl alkylcarbamate, polyvinyl butyral, polvinyl acetal, polyvinyl alcohol, ethyl cellulose, cellulose acetate, nitro cellulose, polyurea, polyurethane, urethane prepolymer, carboxy-modified polyurethane, amino-modified polyurethane, polyurethane acrylate, polyester acrylate, epoxy acrylatel unsaturated polyester, polyether acrylate, N-methylolacryloamide, melamine, methylolmelamine, alkyd resin, phenolic resin, silicone resin, furan resin, resorcinol resin, and epoxy resin.

The above-mentioned crosslinking accelerating agent and catalyst can be appropriately chosen in accordance with the combination of the polymer and/or polymerizable compound having a functional group which is capable of forming a covalent bond in reaction with a crosslinking agent, and a crosslinking agent.

The ultraviolet curing resin composition is composed of a photopolymerizable monomer (a reactive diluent), a photopolymerizable oligomer, and a photopolymerization initiator.

Specific example of the photopolymerizable monomer are mono-functional monomers such as 2-hydroxyethyl acrylate, 2-hydroxypropyl acrylate, 2-ethylhexyl acrylate and 2-hydroxyethyl acryloyl phosphate; bifunctional monomers such as 1,3-butanediol diacrylate, 1,4-butanediol diacrylate, 1,6-hexanediol diacrylate, diethylene glycol diacrylate, tripropylene glycol diacrylate, neopentyl glycol diacrylate, polyethylene glycol diacrylate, and hydroxypivalic acid eater neopentyl glylcol diacrylate; and trifunctional or polyfunctional monomers such as dipentaerythritol, pentaerythritol triacrylate, and trimethylolpropane triacrylate.

Specific examples of the photopolymerizable oligomer are polyester acrylate, epoxy acrylate, urethane acrylate, polyether acrylate, silicone acrylate, alkyd acrylate, and melamine acrylate.

Specific examples of the photopolymerization initiator are benzophenone, mothyl benzoylbenzoate, diethoxy acetophenone, 2-hydroxy-2-mothyl-1-phenylpropan-1-one, 1-hydroxycyclohexyl phenyl ketone, 2-methyl-1-(4-(methylthio)phenyl)-2-morpholinopropane-1, benzoinisobutyl ether, benzoinisopropyl ether, benzoinethyl ether, benzyldimethyl ketal, 2-chlorothioxantone, and 2,4-diethylthioxanthone.

The electron radiation curing resin composition is composed of an unsaturated prepolymer, an oligomer and a reactive diluent (monomer).

Specific examples of the unsaturated prepolyer and oligomer are unsaturated polyester, polyester acrylate, epoxy acrylate, polyurethane acrylate, polyether acrylate, unsaturated acrylic resin, unsaturated silicone and unsaturated fluoroplastics.

Specific examples of the reactive diluent are n-butyl acrylate, 2-ethylhexyl acrylate, 2-hydroxypropyl acrylate, trimethylolpropane acrylate, and pentaerythritol acrylate.

In the reversible thermosensitive recording medium of the present invention, a coloring agent may be contained in at least one layer of the recording layer or the overcoat layer or at least one overlaid layer of the overcoat layer, whereby the shade of the color in the recording medium can be reversibly changed depending upon the changes in the temperature thereof.

Examples of such a coloring agent are inorganic pigments, organic pigments and/or dyes.

Specific examples of the inorganic pigments are chromate, ferrocyanide, sulfide, sulfate and metal powders.

Specific examples of the organic pigments are azo pigments, phthalocyanine pigments, nitro pigments, nitroso pigments, basic-dye-based pigments, and acid-dye-based pigments.

Examples of the dyes are azo dye, anthraquinone dye, nitro dye, nitroso dye, methine dye, thiazole dye, azine dye, oxazine dye, thiazine dye, acridine dye, Alizarine dye, xanthene dye, diphenylmethane dye, atilbene dye, pyrazolone dye, triphenylmethane dye, sulfur dye, and indigoid dye.

The reversible thermosensitive recording medium of the present invention may include printed images between the thermosensitive recording layer and the overcoat layer.

Generally images can be formed on the overcoat layer by the steps of forming printed images by use of an ultraviolet curing ink, and overlaying an over-printing layer on the printed images for protecting the printed images. The over-printing layer, however, is peeled away from the recording medium in the course of repeated printing process by use of heat application means or by the application of energy for erasure to the recording medium, and the peeled portion of the over-printing layer adheres to the heat application means, whereby the quality of obtained thermosensitive images is degraded.

When such printed images are formed between the thermosensitive recording layer and the overcoat layer, the printed images can be provided without causing the above-mentioned deterioration of the thermosensitive images.

Other features of this invention will become apparent in the course of the following description of exemplary embodiments, which are given for illustration of the invention and are not intended to be limiting thereof.

EXAMPLE 1

[Formation of Reversible Thermosensitive Recording Layer]

A solution composed of the following components was prepared:

| | Parts by Weight |
|---|---|
| Diallyl phthalate | 2 |
| Eicosanedioic acid | 4 |
| Behenic acid | 6 |
| Vinyl chloride - vinyl acetate copolymer | 35 |
| Tetrahydrofuran | 150 |
| Toluene | 50 |

The thus prepared coating solution was coated on a 100 μm thick polyethylene terephthalate film (hereinafter referred to as the 100 μm thick PET film) by a wire bar and dried with application of heat thereto, whereby a reversible thermosensitive recording layer with a thickness of about 15 μm was formed on the PET film.

[Formation of Overcoat Layer]

A dispersion of the following components was prepared:

| | Parts by Weight |
|---|---|
| Silicone-modified polyurethane resin (Trademark "SP901" made by Dainichiseika Color and Chemicals Mfg. Co., Ltd.) | 70 |

-continued

| | Parts by Weight |
|---|---|
| Polyisocyanate (Trademark "D-70" made by Dainichiseika Color and Chemicals Mfg. Co., Ltd.) | 30 |
| Calcium carbonate (Trademark "Brilliant-15" made by Shiraishi Kogyo Kaisha, Ltd.) | 0.2 |
| Toluene | 30 |
| Methyl ethyl ketone | 220 |

The thus prepared dispersion was coated on the above prepared reversible thermosensitive recording layer by a wire bar, and dried at 90° C. for 3 minutes, whereby an overcoat layer with a thickness of about 5 μm including protrusions formed thereon, was formed on the reversible thermosensitive recording layer.

The thus formed overcoat layer formed on the reversible thermorensitive recording layer was subjected to heat treatment at 40° C. for 3 days, whereby a reversible thermosensitive recording medium No. 1 of the present invention was fabricated.

The pencil hardness of the overcoat layer of the reversible thermosensitive recording medium No. 1 was 2H, and the number of protrusions formed on the overcoat layer per area of 125 μm×125 μm thereof was in the range of 11 to 50, and the height of the protrusions was in the range of 0.51 to 1.50 μm.

EXAMPLE 2

[Formation of Reversible Thermosensitive Recording Layer]

The same reversible thermosensitive recording layer with a thickness of about 15 μm as in Example 1 was formed on a 100 μm thick PET film in the same manner as in Example 1.

[Formation of Overcoat Layer]

A dispersion of the following components was prepared:

| | Parts by Weight |
|---|---|
| Silicone-modified butyral resin (Trademark "SP701" made by Dainichiseika Color and Chemical Mfg. Co., Ltd.) | 82 |
| Polyisocyanate (Trademark "D-70" made by Dainichiseika Color and Chemicals Mfg. Co., Ltd.) | 18 |
| Calcium carbonate (Trademark "Brilliant-15" made by Shiraishi Kogyo Kaisha, Ltd.) | 0.17 |
| Methyl ethyl ketone | 190 |
| Toluene | 10 |

The thus prepared dispersion was coated on the above prepared reversible thermosensitive recording layer by a wire bar, and dried at 90° C. for 3 minutes, whereby an overcoat layer with a thickness of about 5 μm, including protrusions formed thereon, was formed on the reversible thermosensitive recording layer.

The thus formed overcoat layer formed on the reversible thermosensitive recording layer was subjected to heat treatment at 40° C. for 3 days, whereby a reversible thermosensitive recording medium No. 2 of the present invention was fabricated.

The pencil hardness of the overcoat layer of the reversible thermosensitive recording medium No. 2 was 3H, and the number of protrusions formed on the overcoat layer per area of 125 μm×125 μm thereof was in the range of 11 to 50, and the height of the protrusions was in the range of 0.51 to 1.50 μm.

EXAMPLE 3

[Formation of Reversible Thermosensitive Recording Layer]

The same reversible thermosensitive recording layer with a thickness of about 15 μm as in Example 1 was formed on a 100 μm thick PET film in the same manner as in Example 1.

[Formation of Overcoat Layer]

A dispersion of the following components was prepared:

| | Parts by Weight |
|---|---|
| Ultraviolet curing urethane acrylate (Trademark "Bs575CS-B" made by Arakawa Chemical Industries, Ltd.) | 100 |
| Calcium carbonate (Trademark "Brilliant-15" made by Shiraishi Kogyo Kaisha, Ltd.) | 0.8 |
| Isopropanol | 200 |

The thus prepared dispersion was coated on the above prepared reversible thermosensitive recording layer by a wire bar, and dried at 90° C. for 2 minutes.

The thus coated dispersion was irradiated with ultraviolet light with an intensity of about 450 mJ/cm$^2$, whereby an overcoat layer with a thickness of about 5 μm, including protrusions formed thereon, was formed on the reversible thermosensitive recording layer.

Thus, a reversible thermosensitive recording medium No. 3 of the present invention was fabricated.

The pencil hardness of the overcoat layer of the reversible thermosensitive recording medium No. 3 was 4H, and the number of the protrusions formed on the overcoat layer per area of 125 μm×125 μm thereof was in the range of 11 to 50, and the height of the protrusions was in the range of 0.51 to 1.50 μm.

EXAMPLE 4

[Formation of Reversible Thermosensitive Recording Layer]

The same reversible thermosensitive recording layer with a thickness of about 15 μm as in Example 1 was formed on a 100 μm thick PET film in the same manner as in Example 1.

[Formation of Overcoat Layer]

A dispersion of the following components was prepared:

| | Parts by Weight |
|---|---|
| Electron radiation curing ether acrylate pre-polymer (Trademark "KAYARAD DPC-30" made by Nippon Kayaku Co., Ltd.) | 70 |
| Hydroxypivalic acid ester Neopentyl glycol diacrylate (Trademark "KAYARAD MANDA" made by Nippon Kayaku Co., Ltd.) | 30 |
| Calcium carbonate (Trademark "Brilliant-15" made by Shiraishi Kogyo Kaisha, Ltd.) | 0.8 |
| Methyl ethyl ketone | 45 |

-continued

| | Parts by Weight |
|---|---|
| Toluene | 45 |
| Isopropanol | 5 |

The thus prepared dispersion was coated on the above prepared reversible thermosensitive recording layer by a wire bar, and dried at 90° C. for 2 minutes.

The thus coated dispersion was irradiated with an electron beam with an intensity of about 1 Mrad, whereby an overcoat layer with a thickness of about 4 μm, including protrusions formed thereon, was formed on the reversible thermosensitive recording layer.

Thus, a reversible thermosensitive recording medium No. 4 of the present invention was fabricated.

The pencil hardness of the overcoat layer of the reversible thermosensitive recording medium No. 4 was 5H, and the number of the protrusions formed on the overcoat layer per area of 125 μm×125 μm thereof was in the range of 11 to 50, and the height of the protrusions was in the range of 0.51 to 1.50 μm.

EXAMPLE 5

[Formation of Reversible Thermosensitive Recording Layer]

The same reversible thermosensitive recording layer with a thickness of about 15 μm as in Example 1 was formed on a 100 μm thick PET film in the same manner as in Example 1.

[Formation of Overcoat Layer]

A dispersion of the following components was prepared

| | Parts by Weight |
|---|---|
| Ultraviolet curing urethane acrylate (Trademark "Bs575" made by Arakawa Chemical Industries, Ltd.) | 100 |
| Calcium carbonate (Trademark "Brilliant-15" made by Shiraishi Kogyo Kaisha, Ltd.) | 0.8 |
| Isopropanol | 100 |

The thus prepared dispersion was coated on the above prepared reversible thermosensitive recording layer by a wire bar, and dried at 90° C. for 2 minutes.

The thus coated dispersion was irradiated with ultraviolet light with an intensity of about 450 mJ/cm$^2$, whereby an overcoat layer with a thickness of about 4 μm, including protrusions formed thereon, was formed on the reversible thermosensitive recording layer.

Thus, a reversible thermosensitive recording medium No. 5 of the present invention was fabricated.

The pencil hardness of the overcoat layer of the reversible thermosensitive recording medium No. 5 was 6H, and the number of the protrusions formed on the overcoat layer per area of 125 μm×125 μm thereof was in the range of 11 to 50, and the height of the protrusions was in the range of 0.51 to 1.50 μm.

EXAMPLE 6

[Formation of Reversible Thermosensitive Recording Layer]

The same reversible thermosensitive recording layer with a thickness of about 15 as in Example 1 μm was formed on a 100 μm thick PET film in the same manner as in Example 1.

[Formation of Overcoat Layer]

A dispersion of the following components was prepared:

| | Parts by Weight |
|---|---|
| Ultraviolet curing ester acrylate (Trademark "C4-782" made by Dainippon Ink & Chemicals, Incorporated) | 100 |
| Calcium carbonate (Trademark "Brilliant-15" made by Shiraishi Kogyo Kaisha, Ltd.) | 0.8 |
| Isopropanol | 100 |

The thus prepared dispersion was coated on the above prepared reversible thermosensitive recording layer by a wire bar, and dried at 90° C. for 2 minutes.

The thus coated dispersion was irradiated with ultraviolet light with an intensity of about 450 mJ/cm$^2$, whereby an overcoat layer with a thickness of about 4 μm including protrusions formed thereon, was formed on the reversible thermosensitive recording layer.

Thus, a reversible thermosensitive recording medium No. 6 of the present invention was fabricated.

The pencil hardness of the overcoat layer of the reversible thermosensitive recording medium No. 6 was 7H, and the number of the protrusions formed on the overcoat layer per area of 125 μm×125 μm thereof was in the range of 11 to 50, and the height of the protrusions was in the range of 0.51 to 1.50 μm.

EXAMPLE 7

[Formation of Reversible Thermosensitive Recording Layer]

The same reversible thermosensitive recording layer with a thickness of about 15 μm as in Example 1 was formed on a 100 μm thick PET film in the same manner as in Example 1.

[Formation of Overcoat Layer]

A dispersion of the following components was prepared:

| | Parts by Weight |
|---|---|
| Silicone-modified polyurethane resin (Trademark "SP901" made by Dainichiseika Color and Chemicals Mfg. Co., Ltd.) | 70 |
| Polyisocyanate (Trademark "D-70" made by Dainichiseika Color and Chemicals Mfg. Co., Ltd.) | 30 |
| Calcium carbonate (Trademark "Brilliant-15" made by Shiraishi Kogyo Kaisha, Ltd.) | 0.4 |
| Toluene | 30 |
| Methyl ethyl ketone | 220 |

The thus prepared dispersion was coated on the above prepared reversible thermosensitive recording layer by a wire bar, and dried at 90° C. for 3 minutes, whereby a first overcoat layer with a thickness of about 3.5 μm, including protrusions formed thereon, was formed on the reversible thermosensitive recording layer.

A solution of the following components was prepared:

| | Parts by Weight |
|---|---|
| Ultraviolet curing urethane acrylate (Trademark "Bs575" made by Arakawa Chemical Industries, Ltd.) | 100 |
| Isopropanol | 100 |

The thus prepared solution was coated on the above formed first overcoat layer by a wire bar, and dried at 90° C. for 2 minutes.

The thus coated solution was irradiated with ultraviolet light with an intensity of about 450 mJ/cm$^2$, whereby a second overcoat layer was provided on the first overcoat layer.

The second overcoat layer formed on the first overcoat layer was then subjected to heat treatment at 40° C. for 3 days, whereby an overcoat layer with a thickness of about 4.5 μm, including protrusions formed thereon, was formed on the reversible thermosensitive recording layer.

Thus, a reversible thermosensitive recording medium No. 7 of the present invention was fabricated.

The pencil hardness of the first overcoat layer was 2H, and the number of the protrusions formed on the first overcoat layer per area of 125 μm×125 μm thereof was in the range of 51 to 100.

The pencil hardness of the second overcoat layer was 6H, and the number of the protrusions formed on the second overcoat layer per area of 125 μm×125 μm thereof was in the range of 11 to 50, and the height of the protrusions formed on the second overcoat layer was in the range of 0.15 to 1.05 μm.

EXAMPLE 8

[Formation of Reversible Thermosensitive Recording Layer]

The same reversible thermosensitive recording layer with a thickness of about 15 μm as in Example 1 was formed on a 100 μm thick PET film in the same manner as in Example 1.

[Formation of Overcoat Layer]

A dispersion of the following components was prepared:

| | Parts by Weight |
|---|---|
| Silicone-modified butyral resin (Trademark "SP701" made by Dainichiseika Color and Chemicals Mfg. Co., Ltd.) | 82 |
| Polyisocyanate (Trademark "D-70" made by Dainichiseika Color and Chemicals Mfg. Co., Ltd.) | 18 |
| Calcium carbonate (Trademark "Brilliant-15" made by Shiraishi Kogyo Kaisha, Ltd.) | 0.35 |
| Methyl ethyl ketone | 190 |
| Toluene | 10 |

The thus prepared dispersion was coated on the above prepared reversible thermosensitive recording layer by a wire bar, and dried at 90° C. for 3 minutes, whereby an overcoat layer with a thickness of about 3.5 μm, including protrusions formed thereon, was formed on the reversible thermosensitive recording layer.

A solution of the following components was prepared:

| | Parts by Weight |
|---|---|
| Ultraviolet curing ester acrylate (Trademark "C4-782" made by Dainippon Ink & Chemicals, Incorporated) | 100 |
| Isopropanol | 100 |

The thus prepared solution was coated on the above formed first overcoat layer by a wire bar, and dried at 90° C. for 2 minutes.

The thus coated solution was irradiated with ultraviolet light with an intensity of about 450 mJ/cm$^2$, whereby a second overcoat layer was formed on the first overcoat layer.

The second overcoat layer formed on the first overcoat layer was then subjected to heat treatment at 40° C. for 3 days, whereby an overcoat layer with a thickness of about 4.5 μm, including protrusions formed thereon, was formed on the reversible thermosensitive recording layer.

Thus, a reversible thermosensitive recording medium No. 8 of the present invention was fabricated.

The pencil hardness of the first overcoat layer was 3H, and the number of the protrusions formed on the first overcoat layer per area of 125 μm×125 μm thereof was in the range of 51 to 100.

The pencil hardness of the second overcoat layer was 7H, and the number of the protrusions formed on the second overcoat layer per area of 125 μm×125 μm thereof was in the range of 11 to 50, and the height of the protrusions formed on the second overcoat layer was in the range of 0.51 to 1.50 μm.

EXAMPLE 9

[Formation of Reversible Thermosensitive Recording Layer]

The same reversible thermosensitive recording layer with a thickness of about 15 μm as in Example 1 was formed on a 100 μm thick PET film in the same manner as in Example 1.

| | Parts by Weight |
|---|---|
| Electron radiation curing ether acrylate pre-polymer (Trademark "KAYARAD DPC-30" made by Nippon Kayaku Co., Ltd.) | 70 |
| Hydroxypivalic acid ester Neopentyl glycol diacrylate (Trademark "KAYARAD MANDA" made by Nippon Kayaku Co., Ltd.) | 30 |
| Calcium carbonate (Trademark "Brilliant-15" made by Shiraishi Kogyo Kaisha, Ltd.) | 1.2 |
| Methyl ethyl ketone | 45 |
| Toluene | 45 |
| Isopropanol | 5 |

The thus prepared dispersion was coated on the above prepared reversible thermosensitive recording layer by a wire bar, and dried at 90° C. for 2 minutes.

The thus coated dispersion was irradiated with an electron beam with an intensity of about 1 Mrad, whereby an overcoat layer with a thickness of about 4 μm, including protrusions formed thereon, was formed on the reversible thermosensitive recording layer.

Thus, a reversible thermosensitive recording medium No. 9 of the present invention was fabricated.

The pencil hardness of the overcoat layer of the reversible thermosensitive recording medium No. 9 was 5H, and the number of the protrusions formed on the overcoat layer per area of 125 μm×125 μm thereof was in the range of 51 to 100, and the height of the protrusions was in the range of 0.51 to 1.50 μm.

EXAMPLE 10

[Formation of Reversible Thermosensitive Recording Layer]

The same reversible thermosensitive recording layer with a thickness of about 15 μm as in Example 1 was formed on a 100 μm thick PET film in the same manner as in Example 1.

[Formation of Overcoat Layer]

A dispersion of the following components was prepared:

| | Parts by Weight |
|---|---|
| Electron radiation curing ether acrylate pre-polymer (Trademark "KAYARAD DPCA-30" made by Nippon Kayaku Co., Ltd.) | 70 |
| Hydroxypivalic acid ester Neopentyl glycol diacrylate (Trademark "KAYARAD MANDA" made by Nippon Kayaku Co., Ltd.) | 30 |
| Calcium carbonate (Trademark "Brilliant-15" made by Shiraishi Kogyo Kaisha, Ltd.) | 2 |
| Methyl ethyl ketone | 45 |
| Toluene | 45 |
| Isopropanol | 5 |

The thus prepared dispersion was coated on the above prepared reversible thermosensitive recording layer by a wire bar, and dried at 90° C. for 2 minutes.

The thus coated dispersion was irradiated with an electron beam with an intensity of about 1 Mrad, whereby an overcoat layer with a thickness of about 4 μm, including protrusions formed thereon, was formed on the reversible thermosensitive recording layer.

Thus, a reversible thermosensitive recording medium No. 10 of the present invention was fabricated.

The pencil hardness of the overcoat layer of the reversible thermosensitive recording medium No. 10 was 5H, and the number of the protrusions formed on the overcoat layer per area of 125 μm×125 μm thereof was in the range of 101 to 300, and the height of the protrusions was in the range of 0.51 to 1.50 μm.

EXAMPLE 11

[Formation of Reversible Thermosensitive Recording Loyer]

The same reversible thermosensitive recording layer with a thickness of about 15 μm as in Example 1 was formed on a 100 μm thick PET film in the same manner as in Example 1.

[Formation of Overcoat Layer]

A dispersion of the following components was prepared:

| | Parts by Weight |
|---|---|
| Electron radiation curing ether acrylate pre-polymer (Trademark "KAYARAD DPCA-30" made by Nippon Kayaku Co., Ltd.) | 70 |

-continued

| | Parts by Weight |
|---|---|
| Hydroxypivalic acid ester Neopentyl glycol diacrylate (Trademark "KAYARAD MANDA" made by Nippon Kayaku Co., Ltd.) | 30 |
| Calcium carbonate (Trademark "Brilliant-15" made by Shiraishi Kogyo Kaisha, Ltd.) | 3 |
| Methyl ethyl ketone | 45 |
| Toluene | 45 |
| Isopropanol | 5 |

The thus prepared dispersion was coated on the above prepared reversible thermosensitive recording layer by a wire bar, and dried at 90° C. for 2 minutes.

The thus coated dispersion was irradiated with an electron beam with an intensity of about 1 Mrad, whereby an overcoat layer with a thickness of about 4 μm, including protrusions formed thereon, was formed on the reversible thermosensitive recording layer.

Thus, a reversible thermosensitive recording medium No. 11 of the present invention was fabricated.

The pencil hardness of the overcoat layer of the reversible thermosensitive recording medium No. 11 was 5H, and the number of the protrusions formed on the overcoat layer per area of 125 μm×125 μm thereof was in the range of 301 to 500, and the height of the protrusions was in the range of 0.51 to 1.50 μm.

EXAMPLE 12

[Formation of Reversible Thermosensitive Recording Layer]

The same reversible thermosensitive recording layer with a thickness of about 15 μm as in Example 1 was formed on a 100 μm thick PET film in the same manner as in Example 1.

[Formation of Overcoat Layer]

A dispersion of the following components was prepared:

| | Parts by Weight |
|---|---|
| Electron radiation curing ether acrylate pre-polymer (Trademark "KAYARAD DPCA-30" made by Nippon Kayaku Co., Ltd.) | 70 |
| Hydroxypivalic acid ester Neopentyl glycol diacrylate (Trademark "KAYARAD MANDA" made by Nippon Kayaku Co., Ltd.) | 30 |
| Calcium carbonate (Trademark "Brilliant-15" made by Shiraishi Kogyo Kaisha, Ltd.) | 4 |
| Methyl ethyl ketone | 45 |
| Toluene | 45 |
| Isopropanol | 5 |

The thus prepared dispersion was coated on the above prepared reversible thermosensitive recording layer by a wire bar, and dried at 90° C. for 2 minutes.

The thus coated dispersion was irradiated with an electron beam with an intensity of about 1 Mrad, whereby an overcoat layer with a thickness of about 4 μm, including protrusions formed thereon, was formed on the reversible thermosensitive recording layer.

Thus, a reversible thermosensitive recording medium No. 12 of the present invention was fabricated.

The pencil hardness of the overcoat layer of the reversible thermosensitive recording medium No. 12 was 5H, and the number of the protrusions formed on the overcoat layer per area of 125 μm×125 μm thereof was in the range of 501 to 900, and the height of the protrusions was in the range of 0.51 to 1.50 μm.

[Formation of Reversible Thermosensitive Recording Layer]

The same reversible thermosensitive recording layer with a thickness of about 15 μm as in Example 1 was formed on a 100 μm thick PET film in the same manner as in Example 1.

EXAMPLE 13

[Formation of Overcoat Layer]

A dispersion of the following components was prepared:

| | Parts by Weight |
|---|---|
| Electron radiation curing ether acrylate pre-polymer (Trademark "KAYARAD DPC-30" made by Nippon Kayaku Co., Ltd.) | 70 |
| Hydroxypivalic acid ester Neopentyl glycol diacrylate (Trademark "KAYARAD MANDA" made by Nippon Kayaku Co., Ltd.) | 30 |
| Calcium carbonate (Trademark "Brilliant-15" made by Shiraishi Kogyo Kaisha, Ltd.) | 8 |
| Methyl ethyl ketone | 45 |
| Toluene | 45 |
| Isopropanol | 5 |

The thus prepared dispersion was coated on the above prepared reversible thermosensitive recording layer by a wire bar, and dried at 90° C. for 2 minutes.

The thus coated dispersion was irradiated with an electron beam with an intensity of about 1 Mrad, whereby an overcoat layer with a thickness of about 4 μm, including protrusions formed thereon, was formed on the reversible thermosensitive recording layer.

Thus, a reversible thermosensitive recording medium No. 13 of the present invention was fabricated.

The pencil hardness of the overcoat layer of the reversible thermosensitive recording medium No. 13 was 5H, and the number of the protrusions formed on the overcoat layer per area of 125 μm×125 μm thereof was 901 or more, and the height of the protrusions was in the range of 0.51 to 1.50 μm.

EXAMPLE 14

[Formation of Reversible Thermosensitive Recording Layer]

The same reversible thermosensitive recording layer with a thickness of about 15 μm as in Example 1 was formed on a 100 μm thick PET film in the same manner as in Example 1.

[Formation of Overcoat Layer]

A dispersion of the following components was prepared:

| | Parts by Weight |
|---|---|
| Ultraviolet curing urethane acrylate (Trademark "Bs575CS-B" made by Arakawa Chemical Industries, Ltd.) | 100 |

-continued

| | Parts by Weight |
|---|---|
| Silicon dioxide (Trademark "SNOWTEX-20L" made by Nissan Chemical Industries, Ltd.) | 1.3 |
| Isopropanol | 200 |

The thus prepared dispersion was coated on the above prepared reversible thermosensitive recording layer by a wire bar, and dried at 90° C. for 2 minutes.

The thus coated dispersion was irradiated with ultraviolet light with an intensity of about 450 mJ/cm$^2$, whereby an overcoat layer with a thickness of about 5 μm, including protrusions formed thereon, was formed on the reversible thermosensitive recording layer.

Thus, a reversible thermosensitive recording medium No. 14 of the present invention was fabricated.

The pencil hardness of the overcoat layer of the reversible thermosensitive recording medium No. 14 was 4H, and the number of the protrusions formed on the overcoat layer per area of 125 μm×125 μm thereof was in the range of 51 to 100, and the height of the protrusions was in the range of 0.05 to 0.10 μm.

EXAMPLE 15

[Formation of Reversible Thermosensitive Recording Layer]

The same reversible thermosensitive recording layer with a thickness of about 15 μm as in Example 1 was formed on a 100 μm thick PET film in the same manner as in Example 1.

[Formation of Overcoat Layer]

A dispersion of the following components was prepared:

| | Parts by Weight |
|---|---|
| Ultraviolet curing urethane acrylate (Trademark "Bs575CS-B" made by Arakawa Chemical Industries, Ltd.) | 100 |
| Silicon dioxide (Trademark "P-526U" made by Mizusawa Industrial Chemicals, Ltd.) | 1.3 |
| Isopropanol | 200 |

The thus prepared dispersion was coated on the above prepared reversible thermosensitive recording layer by a wire bar, and dried at 90° C. for 2 minutes.

The thus coated dispersion was irradiated with ultraviolet light with an intensity of about 450 mJ/cm$^2$, whereby an overcoat layer with a thickness of about 5 μm, including protrusions formed thereon, was formed on the reversible thermosensitive recording layer.

Thus, a reversible thermosensitive recording medium No. 15 of the present invention was fabricated.

The pencil hardness of the overcoat layer of the reversible thermosensitive recording medium No. 15 was 4H, and the number of the protrusions formed on the overcoat layer per area of 125 μm×125 μm thereof was in the range of 51 to 100, and the height of the protrusions was in the range of 0.11 to 0.50 μm.

EXAMPLE 16

[Formation of Reversible Thermosensitive Recording Layer]

The same reversible thermosensitive recording layer with a thickness of about 15 μm as in Example 1 was formed on a 100 μm thick PET film in the same manner as in Example 1.

[Formation of Overcoat Layer]

A dispersion of the following components was prepared:

| | Parts by Weight |
|---|---|
| Ultraviolet curing urethane acrylate (Trademark "Bs575CS-B" made by Arakawa Chemical Industries, Ltd.) | 100 |
| Silicon dioxide (Trademark "C-402" made by Mizusawa Industrial Chemicals, Ltd.) | 1.5 |
| Isopropanol | 200 |

The thus prepared dispersion was coated on the above prepared reversible thermosensitive recording layer by a wire bar, and dried at 90° C. for 2 minutes.

The thus coated dispersion was irradiated with ultraviolet light with an intensity of about 450 mJ/cm$^2$, whereby an overcoat layer with a thickness of about 5 μm, including protrusions formed thereon, was formed on the reversible thermosensitive recording layer.

Thus, a reversible thermosensitive recording medium No. 16 of the present invention was fabricated.

The pencil hardness of the overcoat layer of the reversible thermosensitive recording medium No. 16 was 4H, and the number of the protrusions formed on the overcoat layer per area of 125 μm×125 μm thereof was in the range of 51 to 100, and the height of the protrusions was in the range of 0.51 to 1.50 μm.

EXAMPLE 17

[Formation of Reversible Thermosensitive Recording Layer]

A solution composed of the following components was prepared:

| | Parts by Weight |
|---|---|
| Diallyl phthalate | 2 |
| Eicosanedioic acid | 4 |
| Behenic acid | 6 |
| Vinyl chloride - vinyl acetate copolymer | 35 |
| Coloring agent (Trademark "Kayaset Blue K-FL" made by Nippon Kayaku Co., Ltd.) | 3 |
| Tetrahydrofuran | 150 |
| Toluene | 50 |

The thus prepared coating solution was coated on a 100 μm thick PET film by a wire bar and dried with application of heat thereto, whereby a reversible thermosensitive recording layer with a thickness of about 15 μm was formed on the PET film.

[Formation of Overcoat Layer]

A dispersion of the following components was prepared:

| | Parts by Weight |
|---|---|
| Ultraviolet curing urethane acrylate (Trademark "Bs575CS-B" made by Arakawa Chemical Industries, Ltd.) | 100 |
| Calcium carbonate (Trademark "Brilliant-15" made by Shiraishi Kogyo Kaisha, Ltd.) | 0.8 |
| Isopropanol | 200 |

The thus prepared dispersion was coated on the above prepared reversible thermosensitive recording layer by a wire bar, and dried at 90° C. for 2 minutes.

The thus coated dispersion was irradiated with ultraviolet light with an intensity of about 450 mJ/cm$^2$, whereby an overcoat layer with a thickness of about 5 μm, including protrusions formed thereon, was formed on the reversible thermosensitive recording layer.

Thus, a reversible thermosensitive recording medium No. 17 of the present invention was fabricated.

The pencil hardness of the overcoat layer of the reversible thermosensitive recording medium No. 17 was 4H, and the number of the protrusions formed on the overcoat layer per area of 125 μm×125 μm thereof was in the range of 11 to 50, and the height of the protrusions was in the range of 0.51 to 1.50 μm.

EXAMPLE 18

[Formation of Reversible Thermosensitive Recording Layer]

The same reversible thermosensitive recording layer with a thickness of about 15 μm as in Example 1 was formed on a 100 μm thick PET film in the same manner as in Example 1.

[Formation of Overcoat Layer]

A dispersion of the following components was prepared:

| | Parts by Weight |
|---|---|
| Ultraviolet curing urethane acrylate (Trademark "Bs575CS-B" made by Arakawa Chemical Industries, Ltd.) | 100 |
| Calcium carbonate (Trademark "Brilliant-15" made by Shiraishi Kogyo Kaisha, Ltd.) | 0.8 |
| Coloring agent (Trademark "Kayaset Blue K-FL" made by Nippon Kayaku Co., Ltd.) | 8 |
| Isopropanal | 200 |

The thus prepared dispersion was coated on the above prepared reversible thermosensitive recording layer by a wire bar, and dried at 90° C. for 2 minutes.

The thus coated dispersion was irradiated with ultraviolet light with an intensity of about 450 mJ/cm$^2$, whereby an overcoat layer with a thickness of about 5 μm, including protrusions formed thereon, was formed on the reversible thermosensitive recording layer.

Thus, a reversible thermosensitive recording medium No. 18 of the present invention was fabricated.

The pencil hardness of the overcoat layer of the reversible thermosensitive recording medium No. 18 was 4H, and the number of the protrusions formed on the overcoat layer per area of 125 μm×125 μm thereof was in the range of 11 to 50, and the height of the protrusions was in the range of 0.51 to 1.50 μm.

EXAMPLE 19

[Formation of Reversible Thermosensitive Recording Layer]

The same reversible thermosensitive recording layer with a thickness of about 15 μm as in Example 1 was formed an a 100 μm thick PET film in the same manner as in Example 1.

[Formation of Overcoat Layer]

A dispersion of the following components was prepared:

| | Parts by Weight |
|---|---|
| Silicone-modified polyurethane resin (Trademark "SP901" made by Dainichiseika Color and Chemicals Mfg. Co., Ltd.) | 70 |
| Polyisocyanate (Trademark "D-70" made by Dainichiseika Color and Chemicals Mfg. Co., Ltd.) | 30 |
| Calcium carbonate (Trademark "Brilliant-15" made by Shiraishi Kogyo Kaisha, Ltd.) | 0.4 |
| Coloring agent (Trademark "Kayaset Blue K-FL" made by Nippon Kayaku Co., Ltd.) | 10 |
| Toluene | 30 |
| Methyl ethyl ketone | 220 |

The thus prepared dispersion was coated on the above prepared reversible thermosensitive recording layer by a wire bar, and dried at 90° C. for 3 minutes, whereby a first overcoat layer with a thickness of about 3.5 μm, including protrusions formed thereon, was formed on the reversible thermosensitive recording layer.

A solution of the following components was prepared:

| | Parts by Weight |
|---|---|
| Ultraviolet curing urethane acrylate (Trademark "Bs575" made by Arakawa Chemical Industries, Ltd.) | 100 |
| Isopropanol | 100 |

The thus prepared solution was coated on the above formed first overcoat layer by a wire bar, and dried at 90° C. for 2 minutes.

The thus coated solution was irradiated with ultraviolet light with an intensity of about 450 mJ/cm$^2$, whereby a second overcoat layer was provided on the first overcoat layer.

The second overcoat layer formed on the first overcoat layer was then subjected to heat treatment at 40° C. for 3 days, whereby an overcoat layer with a thickness of about 4.5 μm, including protrusions formed thereon, was formed on the reversible thermosensitive recording layer.

Thus, a reversible thermosensitive recording medium No. 19 of the present invention was fabricated.

The pencil hardness of the first overcoat layer was 2H, and the number of the protrusions formed on the first overcoat layer per area of 125 μm×125 μm thereof was in the range of 51 to 100.

The pencil hardness of the second overcoat layer was 6H, and the number of the protrusions formed on the second overcoat layer per area of 125 μm×125 μm thereof was in the range of 11 to 50 and the height of the protrusions formed on the second overcoat layer was in the range of 0.51 to 1.50 μm.

EXAMPLE 20

[Formation of Reversible Thermosensitive Recording Layer]

The same reversible thermosensitive recording layer with a thickness of about 15 μm as in Example 1 was formed on a 100 μm thick PET film in the same manner as in Example 1.

[Formation of Overcoat Layer]

A dispersion of the following components was prepared:

| | Parts by Weight |
|---|---|
| Silicone-modified butyral resin (Trademark "SP701" made by Dainichiseika Color and Chemicals Mfg. Co., Ltd.) | 82 |
| Polyisocyanate (Trademark "D-70" made by Dainichiseika Color and Chemicals Mfg. Co., Ltd.) | 18 |
| Calcium carbonate (Trademark "Briliant-15" made by Shiraishi Kogyo Kaisha, Ltd.) | 0.35 |
| Methyl ethyl ketone | 190 |
| Toluene | 10 |

The thus prepared dispersion was coated on the above prepared reversible thermosensitive recording layer by a wire bar, and dried at 90° C. for 3 minutes, whereby a first overcoat layer with a thickness of about 3.5 μm, including protrusions formed thereon, was formed on the reversible thermosensitive recording layer.

A solution of the following components was prepared:

| | Parts by Weight |
|---|---|
| Ultraviolet curing ester acrylate (Trademark "C4-782" made by Dainippon Ink & Chemicals, Incorporated) | 100 |
| Coloring agent (Trademark "Kayaset Blue K-FL" made by Nippon Kayaku Co., Ltd.) | 12 |
| Isopropanol | 100 |

The thus prepared solution was coated on the above formed first overcoat layer by a wire bar, and dried at 90° C. for 2 minutes.

The thus coated solution was irradiated with ultraviolet light with an intensity of about 450 mJ/cm$^2$, whereby a second overcoat layer was formed on the first overcoat layer.

The second overcoat layer formed on the first overcoat layer was then subjected to heat treatment at 40° C. for 3 days, whereby an overcoat layer with a thickness of about 4.5 μm, including protrusions formed thereon, was formed on the reversible thermosensitive recording layer.

Thus, a reversible thermosensitive recording medium No. 20 of the present invention was fabricated.

The pencil hardness of the first overcoat layer was 3H, and the number of the protrusions formed on the first overcoat layer per area of 125 μm×125 μm thereof was in the range of 51 to 100.

The pencil hardness of the second overcoat layer was 7H, and the number of the protrusions formed on the second overcoat layer per area of 125 μm×125 μm thereof was in the range of 11 to 50, and the height of the protrusions formed on the second overcoat layer was in the range of 0.51 to 1.50 μm.

EXAMPLE 21

[Formation of Reversible Thermosensitive Recording Layer]

The same reversible thermosensitive recording layer with a thickness of about 15 μm as in Example 1 was formed on a 100 μm thick PET film in the same manner as in Example 1.

[Formation of Overcoat Layer]

A dispersion of the following components was prepared:

| | Parts by Weight |
|---|---|
| Ultraviolet curing urethane acrylate (Trademark "Bs575CS-B" made by Arakawa Chemical Industries, Ltd.) | 100 |
| Silicon dioxide (Trademark "P-510" made by Nissan Chemical Industries, Ltd.) | 1.5 |
| Isopropanol | 200 |

The thus prepared dispersion was coated on the above prepared reversible thermosensitive recording layer by a wire bar, and dried at 90° C. for 2 minutes.

The thus coated dispersion was irradiated with ultraviolet light with an intensity of about 450 mJ/cm$^2$, whereby an overcoat layer with a thickness of about 5 μm, including protrusions formed thereon, was formed on the reversible thermosensitive recording layer.

Thus, a reversible thermosensitive recording medium No. 21 of the present invention was fabricated.

The pencil hardness of the overcoat layer of the reversible thermosensitive recording medium No. 21 was 4H, and the number of the protrusions formed on the overcoat layer per area of 125 μm×125 μm thereof was in the range of 51 to 100, and the height of the protrusions was 1.51 μm or more.

EXAMPLE 22

[Formation of Reversible Thermosensitive Recording Layer]

The same reversible thermosensitive recording layer with a thickness of about 15 μm as in Example 1 was formed on a 100 μm thick PET film in the same manner an in Example 1.

[Formation of Overcoat Layer]

A dispersion of the following components was prepared:

| | Parts by Weight |
|---|---|
| Pentaerythritoltetra acrylate (Trademark "Aronix M-450" made by Toagosei Chemical Industry Co., Ltd.) | 16 |
| Bisphenol A type epoxy acrylate (Trademark "KAYARAD R-551" made by Nippon Kayaku Co., Ltd.) | 80 |
| Silicon dioxide (Trademark "P-526U" made by Mizusawa Industrial Chemicals, Ltd.) | 0.5 |
| 1-hydroxycyclohexyl phenyl ketone | 4 |
| Isopropyl alcohol | 75 |
| Ethyl acetate | 10 |
| Toluene | 5 |

The thus prepared dispersion was coated on the above prepared reversible thermosensitive recording layer by a wire bar, and dried at 90° C. for 2 minutes.

The thus coated dispersion was irradiated with ultraviolet light with an intensity of about 800 mJ/cm$^2$, whereby an overcoat layer with a thickness of about 5 μm, including protrusions formed thereon, was formed on the reversible thermosensitive recording layer.

Thus, a reversible thermosensitive recording medium No. 22 of the present invention was fabricated.

The pencil hardness of the overcoat layer of the reversible thermosensitive recording medium No. 22 was 1H, and the number of the protrusions formed on the overcoat layer per area of 125 μm×125 μm thereof was in the range of 11 to 50, and the height of the protrusions was in the range of 0.11 to 0.50 μm.

COMPARATIVE EXAMPLE 1

[Formation of Reversible Thermosensitive Recording Layer]

The same reversible thermosensitive recording layer with a thickness of about 15 μm as in Example 1 was formed on a 100 μm thick PET film in the same manner as in Example 1.

[Formation of Overcoat Layer]

A dispersion of the following components was prepared:

| | Parts by Weight |
|---|---|
| Ultraviolet curing urethane acrylate (Trademark "Bs550B" made by Arakawa Chemical Industries, Ltd.) | 100 |
| Calcium carbonate (Trademark "Brilliant-15" made by Shiraishi Kogyo Kaisha, Ltd.) | 0.8 |
| Isopropanol | 100 |

The thus prepared dispersion was coated on the above prepared reversible thermosensitive recording layer by a wire bar, and dried at 90° C. for 2 minutes.

The thus coated dispersion was irradiated with ultraviolet light with an intensity of about 450 mJ/cm$^2$, whereby an overcoat layer with a thickness of about 4 μm, including protrusions formed thereon, was formed on the reversible thermosensitive recording layer.

Thus, a comparative reversible thermosensitive recording medium No. 1 was fabricated.

The pencil hardness of the overcoat layer of the comparative reversible thermosensitive recording medium No. 1 was F, and the number of the protrusions formed on the overcoat layer per area of 125 μm×125 μm thereof was in the range of 11 to 50, and the height of the protrusions was in the range of 0.51 to 1.50 μm.

COMPARATIVE EXAMPLE 2

[Formation of Reversible Thermosensitive Recording Layer]

The same reversible thermosensitive recording layer with a thickness of about 15 μm in Example 1 was formed on a 100 μm thick PET film in the same manner as in Example 1.

[Formation of Overcoat Layer]

A dispersion of the following components was prepared:

| | Parts by Weight |
|---|---|
| Ultraviolet curing urethane acrylate (Trademark "Bs575CS-B" made by Arakawa Chemical Industries, Ltd.) | 100 |
| Isopropanal | 200 |

The thus prepared dispersion was coated on the above prepared reversible thermosensitive recording layer by a wire bar, and dried at 90° C. for 2 minutes.

The thus coated dispersion was irradiated with ultraviolet light with an intensity of about 450 mJ/cm$^2$, whereby an overcoat layer with a thickness of about 5 μm, including protrusions formed thereon, war formed on the reversible thermosensitive recording layer.

Thus, a comparative reversible thermosensitive recording medium No. 2 was fabricated.

The pencil hardness of the overcoat layer of the comparative reversible thermosensitive recording medium No. 1 was 4H, and no protrusions were formed on the overcoat layer and the overcoat layer was flat.

COMPARATIVE EXAMPLE 3

[Formation of Reversible Thermosensitive Recording Layer]

The same reversible thermosensitive recording layer with a thickness of about 15 μm as in Example 1 was formed on a 100 μm thick PET film in the same manner as in Example 1.

[Formation of Overcoat Layer]

A dispersion of the following components was prepared:

| | Parts by Weight |
|---|---|
| Ultraviolet curing urethane acrylate (Trademark "Bs575CS-B" made by Arakawa Chemical Industries, Ltd.) | 100 |
| Silicon dioxide (Trademark "SNOWTEX O" made by Nissan Chemical Industries, Ltd.) | 1.8 |
| Isopropanol | 200 |

The thus prepared dispersion was coated on the above prepared reversible thermosensitive recording layer by a wire bar, and dried at 90° C. for 2 minutes.

The thus coated dispersion was irradiated with ultraviolet light with an intensity of about 450 mJ/cm$^2$, whereby an overcoat layer with a thickness of about 5 μm, including protrusions formed thereon, was formed on the reversible thermosensitive recording layer.

Thus, a comparative reversible thermosensitive recording medium No. 3 was fabricated.

The pencil hardness of the overcoat layer of the comparative reversible thermosensitive recording medium No. 3 was 4H, and the number of the protrusions formed on the overcoat layer per area of 125 μm×125 μm thereof was in the range of 51 to 100, and the height of the protrusions was in the range of 0.01 to 0.04 μm.

COMPARATIVE EXAMPLE 4

[Formation of Reversible Thermosensitive Recording Layer]

The same reversible thermosensitive recording layer with a thickness of about 15 μm as in Example 1 was formed on a 100 μm thick PET film in the same manner as in Example 1.

[Formation of Overcoat Layer]

A dispersion of the following components was prepared:

| | Parts by Weight |
|---|---|
| Ultraviolet curing ester acrylate (Trademark "C4-782" made by Dainippon Ink & Chemicals, Incorporated) | 100 |
| Isopropanol | 100 |

The thus prepared dispersion was coated on the above prepared reversible thermosensitive recording layer by a wire bar, and dried at 90° C. for 2 minutes.

The thus coated dispersion was irradiated with ultraviolet light with an intensity of about 450 mJ/cm$^2$, whereby an overcoat layer with a thickness of about 4.5 μm including protrusions formed thereon, was formed on the reversible thermosensitive recording layer.

Thus, a comparative reversible thermosensitive recording medium No. 4 was fabricated.

The pencil hardness of the overcoat layer of the comparative reversible thermosensitive recording medium No. 4 was 7H, and protrusions with a height of 0.01 μm or more were not formed on the overcoat layer and the overcoat layer was flat.

The thus fabricated reversible thermosensitive recording media Nos. 1 to 22 of the present invention and the comparative reversible thermosensitive recording media Nos. 1 to 4 were subjected to the following evaluation tests by use of a commercially available thermal printing and erasing apparatus made by Glory Co., Ltd.

More specifically, in the evaluation tests, a solid image was printed in each of the above-mentioned reversible thermosensitive recording media by the above-mentioned thermal printing and erasing apparatus with application of a printing energy of 30.1 mJ/mm$^2$ and a platen pressure of 1.0 kg.

The printed solid image was then erased with the application of heat at an erasing temperature of 107° C., and the image printing and erasing stop was repeated 500 times.

Under the above-mentioned conditions, each reversible thermosensitive recording medium was evaluated with respect to the following points:

1. Periodic undulations formed at the surface of the overcoat layer, corresponding to the dots of a thermal head, were visually inspected in every 100 printing and erasing steps. The evaluation was made in accordance with the following criteria:
   A: No periodic undulations were observed.
   B: Periodic undulations were slightly observed.
   C: Periodic undulations were conspicuously observed.
2. The formation of cracks at the surface of the overcoat layer was visually inspected in every 100 printing and erasing steps. The evaluation was made in accordance with the following criteria:
   G: No cracks were observed.
   NG: Cracks were observed.
3. The peeling of the overcoat layer was visually inspected in every 100 printing and erasing steps. The evaluation was made in accordance with the following criteria:
   G: No peeling was observed.
   NG: Peeling was observed.
4. Smearing of the thermal head employed was inspected by an optical microscope. The evaluation was made in accordance with the following criteria:
   G: No smearing of the thermal head was observed.
   NG: Smearing of the thermal head was observed.
5. The transparency of each reversible thermosensitive recording medium was inspected in terms of the haze thereof which was measured by use of a commercially available full-automatic haze computer (Trademark "HG-2DP" made by Suga Test Instruments Co., Ltd.) in accordance with the Japanese Industrial Standards JIS K 7105. The evaluation was made in accordance with the following criteria:
   G: less than 15
   NG: 15 or more
6. The thermosensitivity of each reversible thermosensitive recording medium was inspected in terms of the printing energy that was required for obtaining clear images by use of a thermal printer made by Glory Co., Ltd. The evaluation was made in accordance with the following criteria:

Ga: Clear images were obtained with the application of a printing energy of 25.3 mJ/mm$^2$ or more.

Gb: Clear Images were obtained with the application of a printing energy of 27.7 mJ/mm$^2$ or more.

NG: Clear images were not obtained even with the application of a printing energy of 30.1 mJ/mm$^2$ or more.

The results of the above-mentioned evaluations are shown in TABLES 1 and 2. In TABLES 1 and 2, the number of the protrusions formed at the overcoat layer of each reversible thermosensitive recording medium, and the heights of the protrusions are shown, which were respectively obtained by counting the actual number and height of each protrusion in a random-sampled area of 125 μm×125 μm of the overcoat layer. In other words, the number of the protrusions and the heights thereof were actually counted or measured, not average values.

In TABLE 1, the number of the protrusions is shown by use of the following symbols:

| | | |
|---|---|---|
| 0d: 0 | 1d: 1 to 10 | 2d: 11 to 50 |
| 3d: 51 to 100 | 4d: 101 to 300 | 5d: 301 to 500 |
| 6d: 501 to 900 | 7d: 901 or more | |

| | | |
|---|---|---|
| 0h: less than 0.01 μm | 1h: 0.01 to 0.04 μm | |
| 2h: 0.05 to 0.10 μm | 3h: 0.11 to 0.50 μm | |
| 4h: 0.51 to 1.50 μm | 5h: 1.51 μm or more | |

TABLE 1

| | Number of Protru- | Height of Protru- | Pencile | Periodic Undulations at Overcoat Layer Surface | | | | | Cracks | | | | | Peeling | | | | |
|---|---|---|---|---|---|---|---|---|---|---|---|---|---|---|---|---|---|---|
| | sions | sions | Hardness | 100 | 200 | 300 | 400 | 500 | 100 | 200 | 300 | 400 | 500 | 100 | 200 | 300 | 400 | 500 |
| Ex. | | | | | | | | | | | | | | | | | | |
| 1 | 2d | 4h | 2H | A | A | A | A | B | G | G | G | G | G | G | G | G | G | G |
| 2 | 2d | 4h | 3H | A | A | A | A | B | G | G | G | G | G | G | G | G | G | G |
| 3 | 2d | 4h | 4H | A | A | A | A | A | G | G | G | G | G | G | G | G | G | G |
| 4 | 2d | 4h | 5H | A | A | A | A | A | G | G | G | G | G | G | G | G | G | G |
| 5 | 2d | 4h | 6H | A | A | A | A | A | G | G | G | G | G | G | G | G | G | NG |
| 6 | 2d | 4h | 7H | A | A | A | A | A | G | G | G | G | G | G | G | G | G | NG |
| 7 | 2d | 4h | 6H | A | A | A | A | A | G | G | G | G | G | G | G | G | G | G |
| 8 | 2d | 4h | 7H | A | A | A | A | A | G | G | G | G | G | G | G | G | G | G |
| Comp. Ex. 1 | 2d | 4h | F | B | B | C | C | C | G | G | G | G | G | G | G | G | G | G |
| Ex. | | | | | | | | | | | | | | | | | | |
| 9 | 3d | 4h | 5H | A | A | A | A | A | G | G | G | G | G | G | G | G | G | G |
| 10 | 4d | 4h | 5H | A | A | A | A | A | G | G | G | G | G | G | G | G | G | G |
| 11 | 5d | 4h | 5H | A | A | A | A | A | G | G | G | G | G | G | G | G | G | G |
| 12 | 6d | 4h | 5H | A | A | A | A | A | G | G | G | G | G | G | G | G | G | G |
| 13 | 7d | 4h | 5H | A | A | A | A | A | G | G | G | G | G | G | G | G | G | G |
| 14 | 3d | 2h | 5H | A | A | A | A | A | G | G | G | G | G | G | G | G | G | G |
| 15 | 3d | 3h | 5H | A | A | A | A | A | G | G | G | G | G | G | G | G | G | G |
| 16 | 3d | 4h | 5H | A | A | A | A | A | G | G | G | G | G | G | G | G | G | G |
| 17 | 3d | 5h | 5H | A | A | A | A | A | G | G | G | G | G | G | G | G | G | G |
| 18 | 2d | 4h | 4H | A | A | A | A | A | G | G | G | G | G | G | G | G | G | G |
| 19 | 2d | 4h | 4H | A | A | A | A | A | G | G | G | G | G | G | G | G | G | G |
| 20 | 2d | 4h | 6H | A | A | A | A | A | G | G | G | G | G | G | G | G | G | G |
| 21 | 3d | 5h | 5H | A | A | A | A | A | G | G | G | G | G | G | G | G | G | G |
| 22 | 2d | 3h | 1H | A | A | A | A | B | G | G | G | G | G | G | G | G | G | G |
| Comp. Ex. | | | | | | | | | | | | | | | | | | |
| 2 | 0d | 0h | 5H | A | B | B | B | B | G | G | G | G | G | G | G | G | G | G |
| 3 | 3d | 1h | 5H | A | A | A | B | B | G | G | G | G | G | G | G | G | G | G |
| 4 | 0d | 0h | 7H | A | A | A | A | A | G | G | NG | NG | NG | G | G | G | G | G |

TABLE 2

| | Smearing of Thermal Head | | | | | Transparency | Thermo-sensi-tivity |
|---|---|---|---|---|---|---|---|
| | 100 | 200 | 300 | 400 | 500 | | |
| Ex. | | | | | | | |
| 1 | G | G | G | G | G | G | Ga |
| 2 | G | G | G | G | G | G | Ga |
| 3 | G | G | G | G | G | G | Ga |
| 4 | G | G | G | G | G | G | Ga |
| 5 | G | G | G | G | G | G | Ga |
| 6 | G | G | G | G | G | G | Ga |
| 7 | G | G | G | G | G | G | Ga |
| 8 | G | G | G | G | G | G | Ga |
| Comp. Ex. 1 | G | NG | NG | NG | NG | G | Ga |
| Ex. | | | | | | | |
| 9 | G | G | G | G | G | G | Ga |
| 10 | G | G | G | G | G | G | Ga |
| 11 | G | G | G | G | G | G | Ga |

TABLE 2-continued

| | Smearing of Thermal Head | | | | | | Thermo-sensi- |
|---|---|---|---|---|---|---|---|
| | 100 | 200 | 300 | 400 | 500 | Transparency | tivity |
| 12 | G | G | G | G | G | G | Ga |
| 13 | G | G | G | G | G | NG | Gb |
| 14 | G | G | G | G | G | G | Ga |
| 15 | G | G | G | G | G | G | Ga |
| 16 | G | G | G | G | G | G | Ga |
| 17 | G | G | G | G | G | G | Ga |
| 18 | G | G | G | G | G | G | Ga |
| 19 | G | G | G | G | G | G | Ga |
| 20 | G | G | G | G | G | G | Ga |
| 21 | G | G | G | G | G | G | Ga |
| 22 | G | G | G | G | G | G | Ga |
| Comp. Ex. | | | | | | | |
| 2 | G | G | G | G | G | G | Ga |
| 3 | G | G | G | G | G | G | Ga |
| 4 | G | G | G | G | G | NG | NG |

Japanese Patent Application No. 07-234642 filed Aug. 22, 1995, and Japanese Patent Application No. (not available yet) filed Aug. 12, 1996 are hereby incorporated by reference.

What is claimed is:

1. A reversible thermosensitive recording medium comprising:

a support material;

a thermosensitive recording layer whose transparency is reversibly changeable depending upon the temperature thereof, which is provided on said support material and comprises a low-molecular-weight organic compound and a resin matrix in which said organic low-molecular-weight compound is dispersed; and an overcoat layer provided at said thermosensitive recording layer, said overcoat layer having a pencil hardness of 1H or more and comprising at the surface thereof at least three protrusions with a height of 0.05 μm or more per area of 125 μm×125 μm of the surface of said overcoat layer.

2. The reversible thermosensitive recording medium as claimed in claim 1, additionally containing at least one layer immediately below said overcoat layer.

3. The reversible thermosensitive recording medium as claimed in claim 2, wherein said top layer has a pencil hardness in the range of 1H to 5H.

4. The reversible thermosensitive recording medium as claimed in claim 2, wherein at least one of said layers and overcoat layer further comprises a coloring agent.

5. The reversible thermosensitive recording medium as claimed in claim 1, further comprising an adhesive layer between said thermosensitive recording layer and said overcoat layer.

6. The reversible thermosensitive recording medium as claimed in claim 1, wherein the surface area of said overcoat layer except said protrusions thereon is flat.

7. The reversible thermosensitive recording medium as claimed in claim 1, wherein each of said protrusions comprises particles.

8. The reversible thermosensitive recording medium as claimed in claim 7, wherein said particles have a particle size in the range of 0.1 to 3.0 μm.

9. The reversible thermosensitive recording medium as claimed in claim 1, wherein at least part of said overcoat layer comprises a thermoset resin composition.

10. The reversible thermosensitive recording medium as claimed in claim 1, wherein at least part of said overcoat layer comprises an ultraviolet-curling resin composition.

11. The reversible thermosensitive recording medium as claimed in claim 1, wherein at least part of said overcoat layer comprises an electron radiation curing resin composition.

12. The reversible thermosensitive recording medium as claimed in claim 1, wherein the number of said protrusions per area of 125 μm×125 μm of the surface of said overcoat layer is in the range of 3 to 900.

13. The reversible thermosensitive recording medium as claimed in claim 1, wherein said overcoat layer has a pencil hardness in the range of 1H to 8H.

14. The reversible thermosensitive recording medium as claimed in claim 1, wherein each of said protrusions has a height in the range of 0.05 μm to 1.50 μm.

15. The reversible thermosensitive recording medium as claimed in claim 1, wherein said thermosensitive recording layer further comprises a coloring agent.

16. The reversible thermosensitive recording medium as claimed in claim 1, wherein said overcoat layer further comprises a coloring agent.

17. The reversible thermosensitive recording medium as claimed in claim 1, wherein at least one of said thermosensitive recording layer or said overcoat layer further comprises a coloring agent.

18. The reversible thermosensitive recording medium as claimed in claim 1, further comprising a printed image which is disposed between said thermosensitive recording layer and said overcoat layer.

* * * * *

UNITED STATES PATENT AND TRADEMARK OFFICE

CERTIFICATE OF CORRECTION

PATENT NO. : 5,780,387

DATED : July 14, 1998

INVENTOR(S): Shigeyuki Harada

It is certified that an error appears in the above-identified patent and that said Letters Patent is hereby corrected as shown below:

Column 2, Line 26, "an" should read --as--.

Column 3, Line 5, "X5401," should read --K5401,--.

Column 3, Line 12, "layes" should read --layers--.

Column 6, Line 57, "he" should read --the--.

Column 6, Line 59, "lose" should read --less--.

Column 9, Line 2, "polvinyl" should read --polyvinyl--.

Column 16, Lines 41 and 42, should read --[Formation of Overcoat Layer] A dispersion of the following components was prepared:--.

Column 26, Line 66, "war" should read --was--.

Signed and Sealed this

Nineteenth Day of October, 1999

*Attest:*

*Attesting Officer*

Q. TODD DICKINSON

*Acting Commissioner of Patents and Trademarks*